US007155942B2

(12) United States Patent
Cho et al.

(10) Patent No.: US 7,155,942 B2
(45) Date of Patent: Jan. 2, 2007

(54) BALANCE WEIGHT IN DRUM TYPE WASHING MACHINE AND MANUFACTURING METHOD THEREOF

(75) Inventors: Jae Gyu Cho, Kyongsangnam-do (KR); Sam Je Park, Kyongsangnam-do (KR); Song Kue Yoo, Kyongsangnam-do (KR); Sun Woo Kim, Kyongsangnam-do (KR); Il Rok Heo, Pusan-Kwangyoki-shi (KR)

(73) Assignee: LG Electronics Inc., Seoul (KR)

( * ) Notice: Subject to any disclaimer, the term of this patent is extended or adjusted under 35 U.S.C. 154(b) by 451 days.

(21) Appl. No.: 10/175,333

(22) Filed: Jun. 20, 2002

(65) Prior Publication Data

US 2003/0029206 A1 Feb. 13, 2003

(30) Foreign Application Priority Data

Jun. 21, 2001 (KR) ..... P2001-35513
Apr. 16, 2002 (KR) ..... P2002-20526

(51) Int. Cl.
*D06F 37/22* (2006.01)

(52) U.S. Cl. ..... 68/24; 68/58; 68/142; 68/23.2; 68/23.1

(58) Field of Classification Search ..... 68/24, 68/58, 142, 23 R, 23.2, 23.1
See application file for complete search history.

(56) References Cited

U.S. PATENT DOCUMENTS

| | | | | | |
|---|---|---|---|---|---|
| 2,926,136 | A * | 2/1960 | Smith et al. | ..... | 210/360.1 |
| 3,088,596 | A * | 5/1963 | Bullock | ..... | 210/382 |
| 3,185,255 | A | 5/1965 | Bird | | |
| 3,330,137 | A * | 7/1967 | Ketter | ..... | 68/23.7 |
| 3,334,497 | A * | 8/1967 | Waldrop | ..... | 68/23.3 |
| 3,370,444 | A * | 2/1968 | Wolters | ..... | 68/207 |
| 3,475,928 | A * | 11/1969 | Wasemann | ..... | 68/23.2 |
| 3,580,014 | A * | 5/1971 | Mazza | ..... | 68/23.1 |
| 4,110,388 | A * | 8/1978 | Wiene | ..... | 264/71 |
| 4,423,607 | A * | 1/1984 | Munini | ..... | 68/23.2 |
| 4,502,303 | A | 3/1985 | Wasemann | | |
| 4,519,223 | A * | 5/1985 | Wasemann | ..... | 68/23.5 |
| 5,211,038 | A * | 5/1993 | Valent | ..... | 68/23.2 |
| 5,419,164 | A * | 5/1995 | Durazzani | ..... | 68/23.2 |
| 5,974,839 | A * | 11/1999 | Johnson et al. | ..... | 68/23.2 |
| 6,067,822 | A * | 5/2000 | Heinzel et al. | ..... | 68/23.2 |
| 6,557,256 | B1 * | 5/2003 | Billings et al. | ..... | 29/897.34 |

FOREIGN PATENT DOCUMENTS

| | | | |
|---|---|---|---|
| CN | 1241656 A | | 2/2000 |
| DE | 40 31 643 | * | 4/1991 |
| DE | 196 39 968 | | 4/1998 |
| DE | 198 00 809 | * | 1/1999 |
| DE | 197 55 173 | | 6/1999 |
| EP | 0 561 201 | | 9/1993 |
| EP | 0 623 436 | | 11/1994 |

(Continued)

OTHER PUBLICATIONS

European Patent Office 307,282 3-1999.*

(Continued)

*Primary Examiner*—Frankie L. Stinson
(74) *Attorney, Agent, or Firm*—McKenna Long & Aldridge LLP

(57) ABSTRACT

A cement balance weight for a drum type washing machine and its manufacturing method. The balance weight includes a housing having a predetermined inner space and an opening for cement injection. The housing includes coupling features that assist coupling the balance weight with a tub.

39 Claims, 7 Drawing Sheets

FOREIGN PATENT DOCUMENTS

| | | | |
|---|---|---|---|
| EP | 0 798 412 | | 10/1997 |
| EP | 0 969 134 | | 1/2000 |
| FR | 2 506 418 | * | 11/1982 |
| FR | 2 580 679 | * | 10/1986 |
| FR | 2 654 443 | * | 5/1991 |
| FR | 2 789 620 | | 8/2000 |
| GB | 2044298 | * | 10/1980 |
| GB | 33 23 148 | * | 12/1983 |
| GB | 2121833 | * | 1/1984 |
| GB | 2241251 | * | 8/1991 |
| GB | 2294952 | * | 5/1996 |
| JP | 7-158116 | * | 6/1995 |
| JP | 9-302724 | * | 11/1997 |
| JP | 11-197388 | * | 7/1999 |
| JP | 2000-24377 | * | 1/2000 |
| JP | 2000335987 | | 12/2000 |
| JP | 2001-269497 | * | 10/2001 |
| WO | WO 00/22220 | | 4/2000 |
| WO | WO 00/222220 | | 4/2000 |
| WO | WO 01/42552 | | 6/2001 |

OTHER PUBLICATIONS

European Patent Office 0 519 146 Dec. 1992.*
European Patent Office 0 623 436 Nov. 1994.*
European Patent Office 0 812 946 Jun. 1996.*
Eurpoena Patent Office 0 969 134 Oct. 1998.*
European Patent Office 0 152 745 Aug. 1985.*
European Patent Office 0 326 502 Aug. 1989.*

* cited by examiner

BALANCE WEIGHT IN DRUM TYPE WASHING MACHINE AND MANUFACTURING METHOD THEREOF

This application claims the benefit of Korean Application Nos. P2001-35513 and P2002-20526, respectively filed on Jun. 21, 2001 and Apr. 16, 2002, and which are hereby incorporated by reference.

BACKGROUND OF THE INVENTION

1. Field of the Invention

The present invention relates to drum type washing machines. More particularly, the present invention relates to balance weights for drum type washing machines that reduce vibration caused by laundry imbalance.

2. Discussion of the Related Art

Generally, a washing machine removes laundry dirt and stains using chemical decomposition and mechanical impact. Modem washing machines are usually one of two basic types, a drum type and a pulsator type. The drum type washing machine is usually more compact than the pulsator type washing machine, has a greater washing capacity, and has reduced laundry entanglements. Thus, demand for drum type washing machines is increasing.

The construction of a typical drum type washing machine is explained briefly by referring to FIG. 1. As shown, a drum type washing machine includes a tub 2 that is supported by a damper 7 and by a spring 6, which are both attached to a body 1. A rotating cylindrical drum 3 is installed in the tub 2. A driving part 5 is coupled to the drum 3 by a shaft 4. The driving part 5, which is installed at the rear of the tub 3, includes a rotor 5*b* and a stator 5*a*. The shaft 4 rotates with the drum 3 and is beneficially directly coupled to the rotor 5*b* to transfer driving force directly to the drum 3 without that aid of a pulley or belt.

Still referring to FIG. 1, a door 8 is installed at the front of the body 1. A gasket 9 is installed between the door and drum to maintain the drum 3 airtight. A controller part 10 is installed over the door 8 to enable an operator to control the operation of the washing machine. Additionally, balance weights 14 and 15 are installed on the tub 2 to prevent vibration of the driving part 5 when laundry in the drum 3 is imbalanced.

The washing machine operates when the turning force of the rotor 5*b* is transferred to the drum 3 through the washing shaft 4 to rotate the drum 3. Laundry in the drum 3 is lifted up by a baffle 3*a* so as to fall free due to gravity.

Referring now to FIG. 2, the balance weights 14 and 15, generically represented by a cement 11 element, are fixed to the tub by a locking boss 12 and by a locking bolt 13. Generally, the balance weights 14 and 15 are made of either cement or cast-iron. A process of making a cement balance weight follows.

First, a mold having a predetermined shape is disassembled. Cement is then injected into the disassembled mold. Then, the mold is reassembled and the cement is cured by thermal treatment. The mold is then disassembled and the cured and molded cement is removed. The surface of the molded cement is then trimmed and treated with a spray coating. The completed balance weights 14 and 15 are then located on the locking boss 12 and the locking bolt 13 is mated with the locking boss 12 to complete the assembly.

While generally successful, the above process of preparing the balance weights 14 and 15 and fixing them to the tub 2 has problems. For example, the overall process is rather complicated, has low productivity, and is relatively costly.

Moreover, cement balance weights 14 and 15 formed and mounted as described suffer from problems related to the locking boss 12 and locking bolt 13 being directly coupled with the cement 11 (which generically represents the balance weights 14 and 15). Relative motion between the cement balance weights 14 and 15 and the locking structure generates dust. Thus, the working environment is degraded and the cement dust can negatively impacts worker's health.

In contrast to cement weights, cast-iron balance weights require painting to prevent rust, a boring process for forming a locking hole, and a subsequent step of removing metal burrs. Thus, cast-iron balance weights have their own set of fabrication problems. Moreover, cast-iron balance weights 14 and 15 are vulnerable to vibration that unscrews the locking bolt 13.

Therefore, a new cement balance weight would be beneficial. Even more beneficial would be a new cement balance weight that is easier and less costly to fabricate. Still more beneficial would be a new cement balance weight that does not produce cement dust.

SUMMARY OF THE INVENTION

Accordingly, the present invention is directed to balance weight for a drum type washing machine and to a manufacturing method thereof that substantially obviates one or more problems due to limitations and disadvantages of the related art.

An object of the present invention is to provide a low cost balance weight for a drum type washing machine and a manufacturing method thereof.

Another object of the present invention is to provide a balance weight in a drum type washing machine that does less harm while reducing production costs.

Another object of the present invention is to provide a simple method of manufacturing a balance weight for a drum type washing machine.

Additional advantages, objects, and features of the invention will be set forth in the description that follows and will become apparent to those having ordinary skill in the art upon examination of the following or may be learned from practicing the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a balance weight in a drum type washing machine according to the present invention includes a housing for coupling with a tub. The housing having a predetermined inner space that is filled with cement. Additionally, the housing includes a coupling system for coupling the housing to a tub.

Preferably, the housing includes a lower case having a bottom surface for coupling with a tub and a lateral side. The housing then further includes an upper cover for sealing the lower case. Beneficially, such a balance weight further includes a separation prevention mechanism that prevents separation of the upper cover and the lower case and that prevents escape of cement dust.

Alternatively, the housing is an integral unit having an upper surface with a cement injection inlet, a bottom surface, and a lateral surface between the upper and bottom surfaces, wherein the upper, bottom, and lateral surfaces surround a predetermined space inside the housing. The balance weight can include a cover over a cement injection inlet. For example, the cover could be a wire netting solidified by cement.

Beneficially, the coupling system includes an insertion hole for receiving at least one locking bolt and that extends from the upper surface to the bottom surface.

In a further aspect of the present invention, a method of manufacturing a balance weight for a drum type washing machine includes molding a housing using a metal mold having a predetermined shape, injecting cement inside the housing, and curing the cement. An additional step of coupling the housing with a tub can be performed.

Molding can be performed by plastic injection molding to form a lower case and an upper cover, wherein the lower case comprises bottom and lateral surfaces that surround a predetermined space, wherein the lower case includes at least a first insertion hole, and wherein the upper cover seals an opening of the lower case and has a second insertion hole.

Molding can include the steps of inserting a tube made of a blow molding resin material into a metal mold having an inner shape of the desired housing, blowing the tube by injecting air into the tube while the metal mold is airtight, and cooling the tube to harden it.

Curing can be performed at room temperature or by the application of steam at a temperature higher than room temperature.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to illustrated embodiments of the present invention, examples of which are shown in the accompanying drawings. Wherever possible, the same reference numbers will be used throughout the drawings to refer to the same or to like parts.

Figure 1:
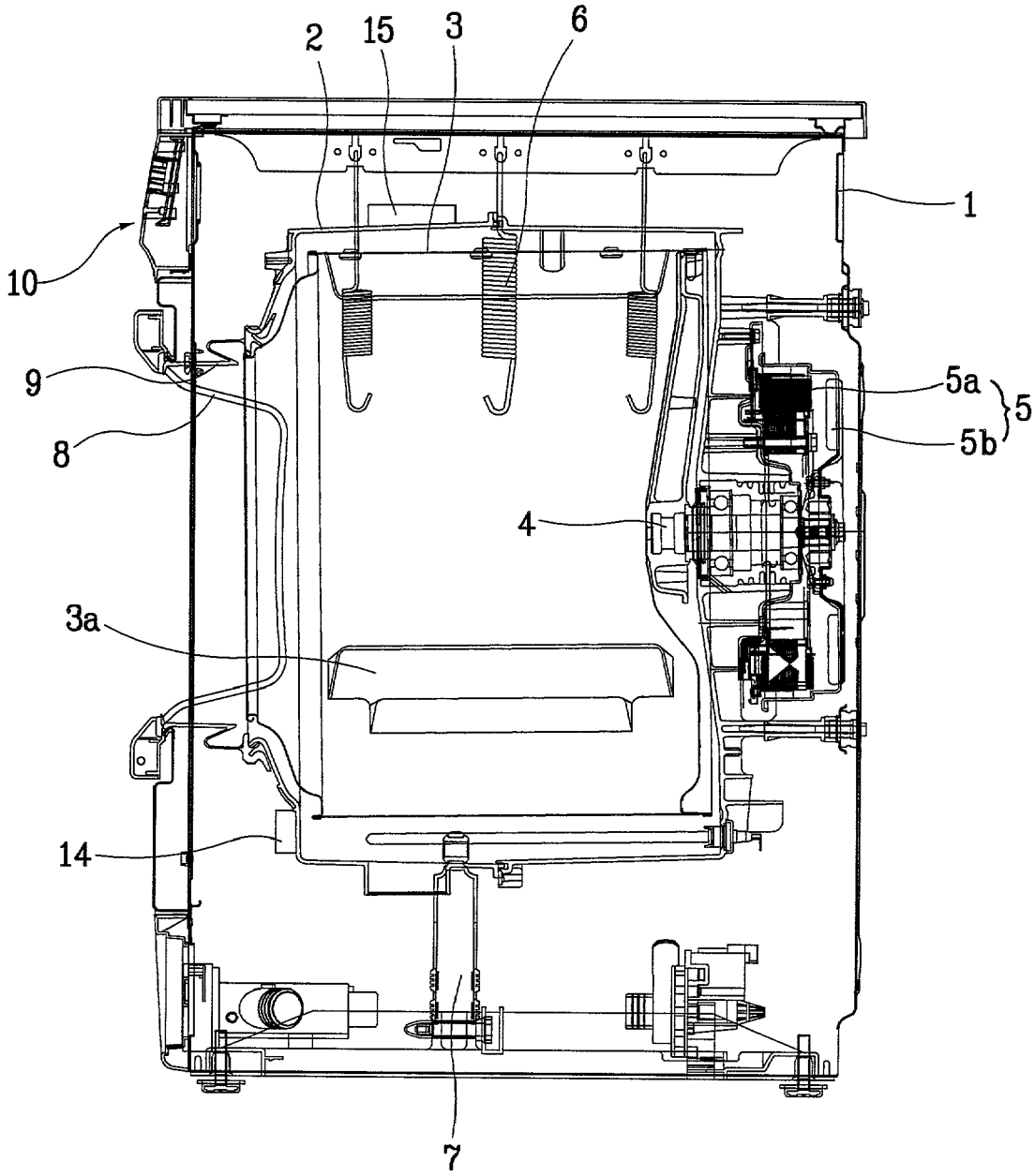
FIG.1 Related Art
FIG. 1 illustrates a cross-sectional view of a general drum type washing machine according to the related art.
Figure 2:
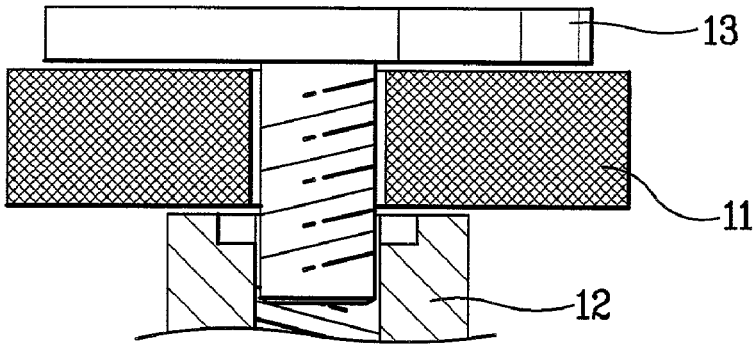
FIG.2 Related Art
FIG. 2 illustrates a cross-sectional view of a balance weight used in a drum type washing machine according to a related art.
Figure 3:
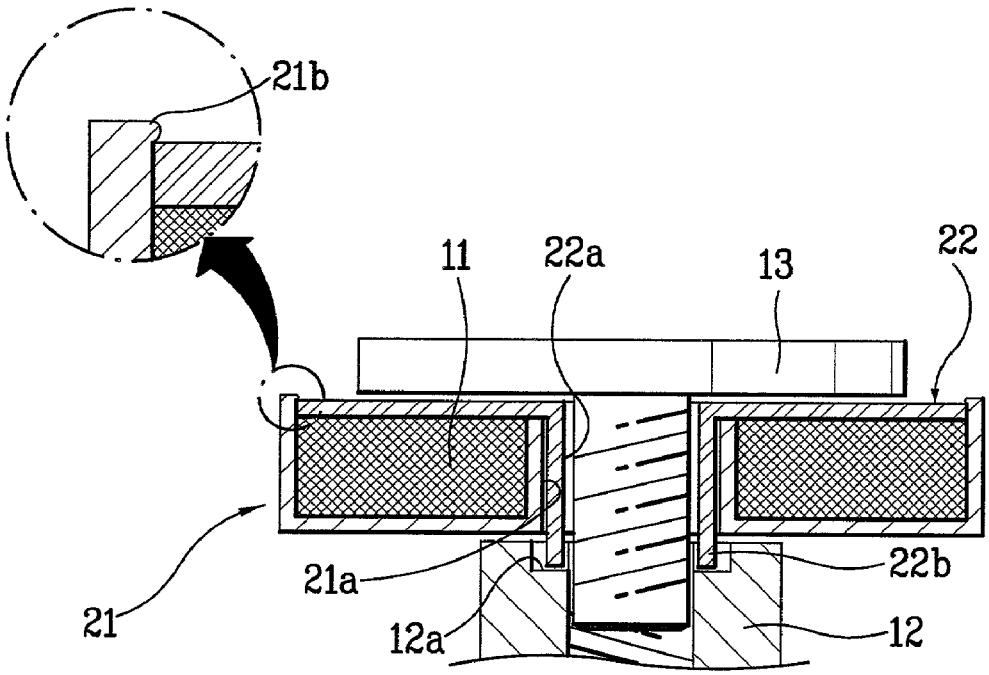
FIG. 3 illustrates a cross-sectional view of a balance weight according to a first embodiment of the present invention.
Figure 4:
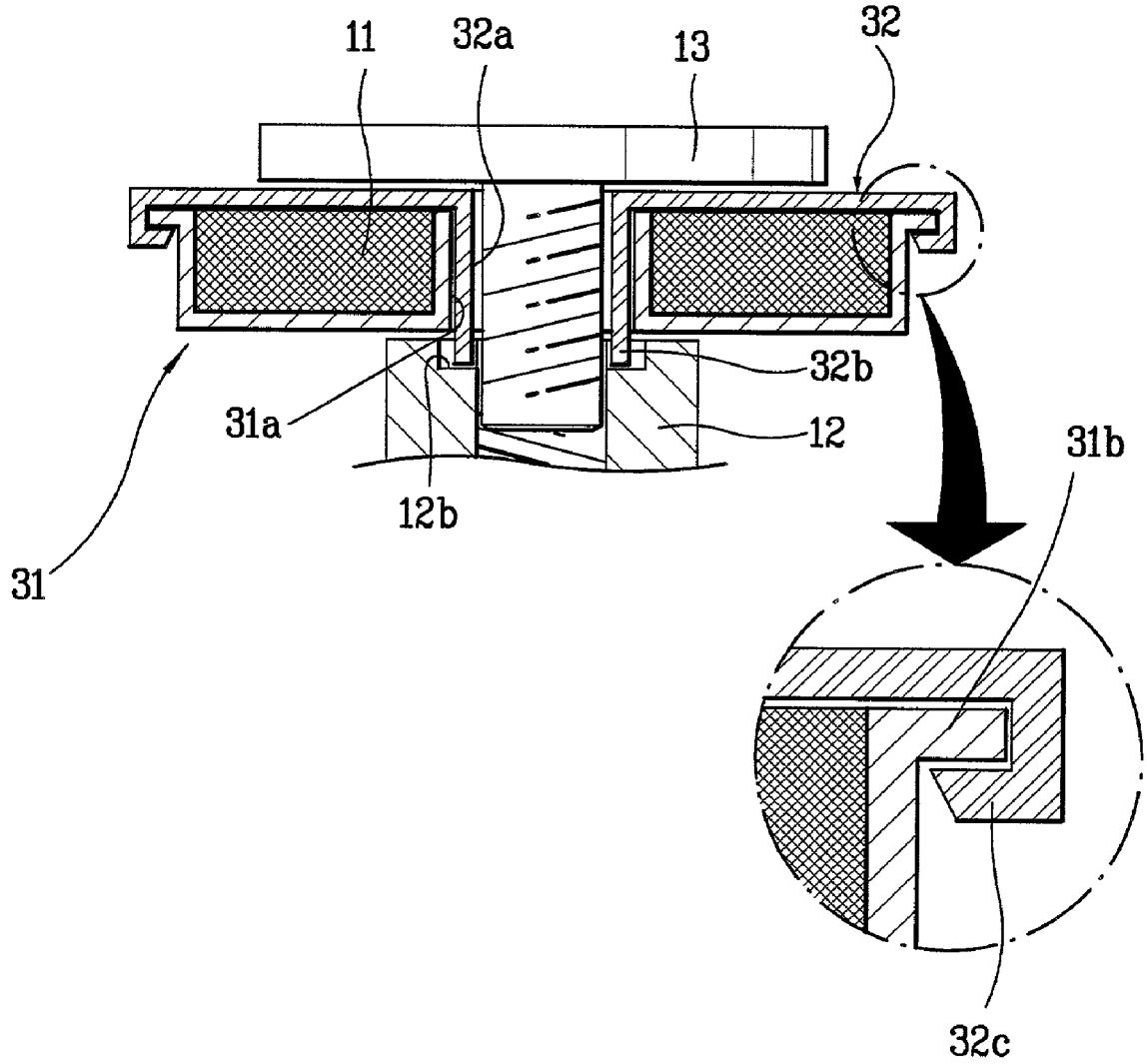
FIG. 4 illustrates a cross-sectional view of another balance weight according to a first embodiment of the present invention.

A balance weight according to a first embodiment of the present invention is explained with reference to both FIG. 3 and to FIG. 4. FIG. 3 illustrates a cross-sectional view of a first balance weight according to a first embodiment of the present invention, while FIG. 4 illustrates a cross-sectional view of another balance weight according to the first embodiment of the present invention.

FIG. 3 shows a locking boss 12 that is formed on a tub. In practice, the tub might have numerous locking bosses. In FIG. 3*a* balance weight is attached to an upper part of the locking boss 12. The balance weight itself includes a lower case 21 having both a bottom surface and a lateral surface that surround a predetermined space. Cement 11 is received in the space and held there by the lower case 21. An upper cover 22 seals a top opening of the lower case 21. Thus, the lower case 21 and upper cover 22 construct a housing that holds cement 11.

The housing (and thus the lower case 21 and upper cover 22) can have any number of shapes, such as a hexahedron, a sphere, or the like. However, the bottom surface of the lower case 21 preferably corresponds to the surface of the tub.

To couple the lower case 21 to the upper cover 22, and to couple the housing to the tub, the lower case 21 includes a first insertion hole 21*a* defined by the lateral surface. A second insertion hole 22*a* is defined by the upper cover 22. A locking bolt 13 passes through the second insertion hole 22*a* and couples the locking boss 12 to the balance weight.

Beneficially, the first insertion hole 21*a* extends from the bottom surface of the lower case 21 to a location that is equal to or lower than the top of the lateral surface of the lower case 21. Furthermore, the second insertion hole 22*a* extends from the top of the upper cover 22 downward so as to pass all the way through the first insertion hole 21*a*. Thus, the outer diameter of the second insertion hole 22*a* is less than the inner diameter of the first insertion hole 21 a. Additionally, an end part 22*b* of the second insertion hole 22*a* beneficially fits into a recessed upper end 12*a* of the locking boss 12. This assists positive coupling of the housing to the tub.

Since the locking bolt 13 couples to the locking boss 12 through the second insertion hole 22*a*, and since the second insertion hole 22*a* penetrates the first insertion hole 21*a*, the lower case 21 and the upper cover 22 are strongly coupled together. A cross-sectional view of the housing shows a rectangular space having predetermined dimensions that are defined by the lower case 21 and by the upper cover 22. That rectangular space is filed by cement 11.

To prevent separation of the ends of the lower case 21 and the upper cover 22 when cement 11 is placed in the space, the housing beneficially includes a separation prevention mechanism that prevents separation of the ends of the upper cover 22 and the lower case 21. One separation prevention mechanism is shown in the expanded bubble of FIG. 3. An undercut 21*b* is formed at the end of the lateral surface of the lower case 21. As shown, the undercut 21*b* extends inward and covers an edge of the upper surface of the upper cover 22.

Another separation prevention mechanism is shown in the expanded bubble of FIG. 4. As shown, the separation prevention mechanism includes a protrusion 31*b* that extends outward from the lateral surface of a lower case 31. A hook 32*c* extends from an edge of an upper cover 32 and hooks over the protrusion 31*b*. The length of the protrusion 31*b* should be within the elastic range of the hook 32*c*.

The undercut 21*b*, or the protrusion 31*b* and the hook 32*c*, depend on the elasticity of the material that forms the lower case 21 or 31 and the upper cover 22 or 32. Beneficially, that material is a synthesized resin material (plastic) having a predetermined elasticity.

A process of manufacturing the first embodiment balance weight is explained as follows. First, a plastic is injected into a metal mold having a predetermined shape so as to form the lower case and upper cover by injection molding. Thus, the lower case 21 or 31 includes a bottom surface and a lateral surface that surround a predetermined space and that forms a first insertion hole 21*a* or 31*a*. Additionally, an upper cover 22 and 32 having a second insertion hole 22*a* or 32*a* is formed by injection molding. Subsequently, cement 11 is injected into the predetermined space. Then, the lower case 21 or 31 and the upper cover 22 or 32 are mated such that the second insertion hole 22*a* or 32*a* penetrates the first insertion hole 21*a* or 31*a*, and such that the separation prevention mechanism prevents the housing from separating. The cement 11 is then cured, beneficially by natural curing at room temperature or using steam at a higher temperature. Then, the balance weight is mounted on the locking boss 12 and the locking bolt 13 is screwed into the locking boss 12.

A balance weight in a drum type washing machine according to a second embodiment of the present invention is explained with reference to FIGS. 5–7 and 10.

Figure 5:
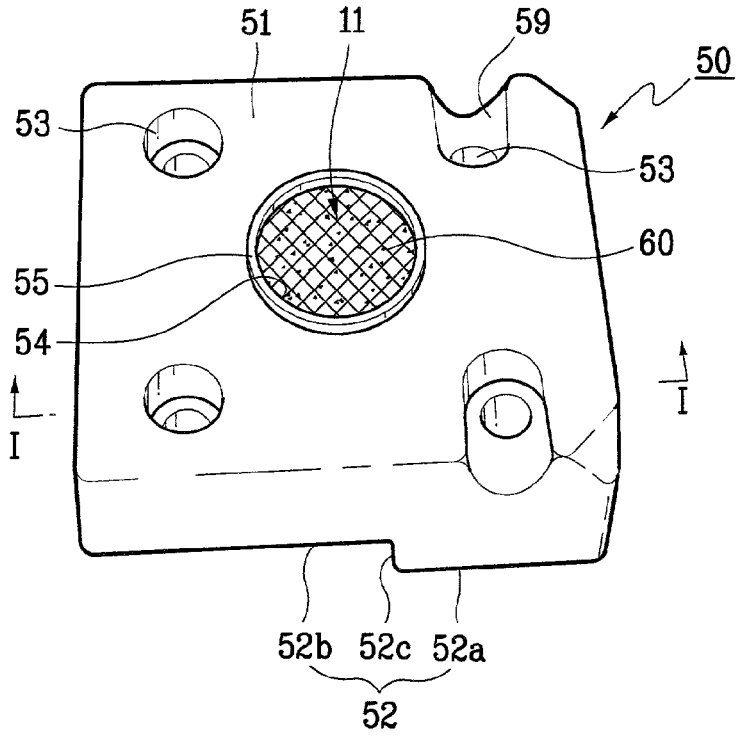
FIG. 5 illustrates a top down view of a balance weight according to a second embodiment of the present invention.
Figure 6:
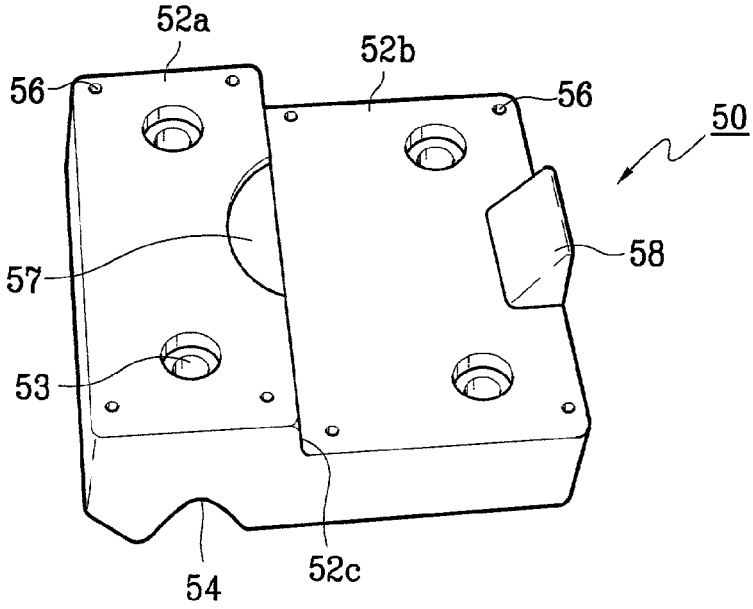
FIG. 6 illustrates a bottom view of the balance weight according to the second embodiment of the present invention.
Figure 7:
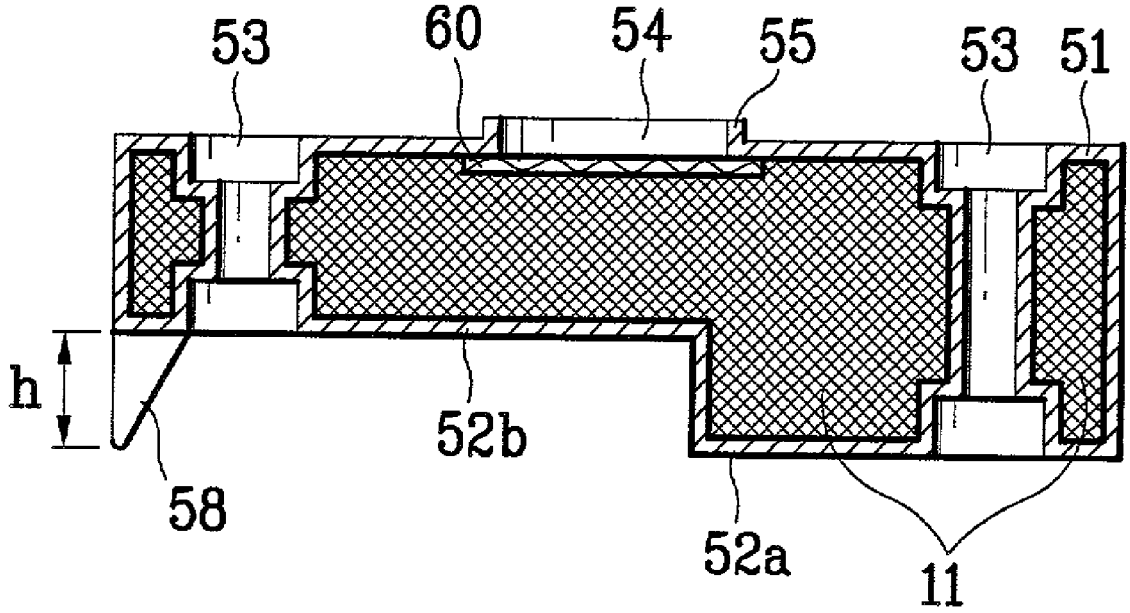
FIG. 7 illustrates a cross-sectional view taken along cutting line I—I in FIG. 5.

FIG. 5 illustrates a top down view of a balance weight according to the second embodiment of the present invention, FIG. 6 illustrates a bottom view of the second embodiment, and FIG. 7 illustrates a cross-sectional view taken along line I—I of FIG. 5.

Referring now to FIG. 5 through FIG. 7, a balance weight according to the second embodiment includes a housing 50 having a bottom surface 52, a lateral surface, and an upper surface 51 that surround a predetermined inner space. Cement 11 fills the inner space of the housing 50.

To assist couple the housing 50 to a tub, the housing 50 includes a step 52*c* on the bottom surface 52. For example, the bottom surface 52 includes a first bottom surface 52*a* and a lower second bottom surface 52*b*.

A cement injection inlet 54 is formed at the center of the upper surface 51. Additionally, at least one air vent 56 is formed through the bottom surface 52. Air in the housing 50 comes out through the vent 56 when cement 11 is injected into the housing 50. While the air vent 56 could be formed through any surface of the housing 50, since the cement 11 is injected through the cement injection inlet 54, the air vent 56 is preferably formed through the bottom surface 52.

Additionally, a plurality of locking bolt insertion holes 53 are formed near the cement injection inlet 54 of the housing 50 so as to penetrate the upper and bottom surface 51 and 52. Locking bolts can then couple the balance weight to a tub having a locking boss via the locking bolt insertion hole 53. A concave recess 59 is beneficially formed on the upper surface 51. The concave recess 59 is formed outside a locking bolt insertion hole 53 so as to make a smooth flow of resin when the housing 50 is molded. Additionally, a flange 55 is formed at the edge of the cement injection inlet 54. This assists cement 11 injection and prevents cement from overflowing the cement injection inlet 54.

Additionally, a leg 58 beneficially protrudes from the bottom surface of the housing. The leg 58 compensates for the step when the cement 11 injected by making the housing level. Thus, the leg 58 should protrude the height h between the first and second bottom surface 52*a* and 52*b*.

If strong vibrations are repeatedly transferred to the balance weight by the tub, the cement 11 could break. In that event cement pieces could come out the cement injection inlet 54. To prevent this, a cover 60 (see FIG. 7) is located over the cement injection inlet 54. The cover 60 is preferably a wire netting that is solidified by the cement 11. When the wire netting 60 is solidified by the cement 11, the strength of the cement around the wire netting is greatly improved. Hence, even if strong vibrations are repeatedly applied to the tub, the cement 11 near the cement injection inlet 54 is unlikely to be broken.

In some applications it will be beneficial to stack a number of housings 50 together. However, the flange 55 that protrudes from the upper surface 51 hinders stacking. To overcome this problem, a landing recess 57 (see FIG. 6) is beneficially formed at the bottom surface 52. That landing recess 57 mates with the flange 55.

If the bottom surface 52 of the housing 50 has a step difference, it is sufficient to form the landing recess 57 at the higher bottom surface 52*a* only. For instance, the landing recess 57 shown in FIG. 6 is formed in the first bottom surface 52*a*. Beneficially, the landing recess 57 is semicircular.

Figure 8:
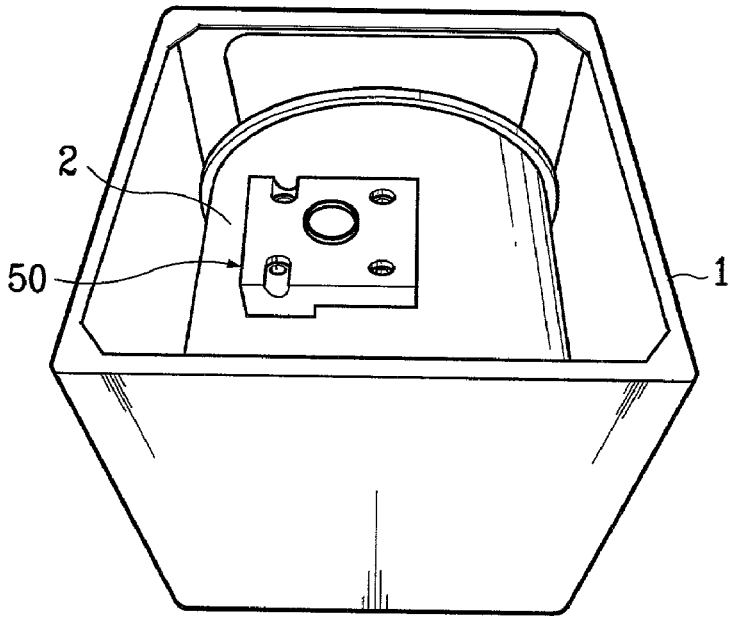
FIG. 8 illustrates a top down view of a balance weight according to the principles of the present invention that is installed on the side of a tub.
Figure 9:
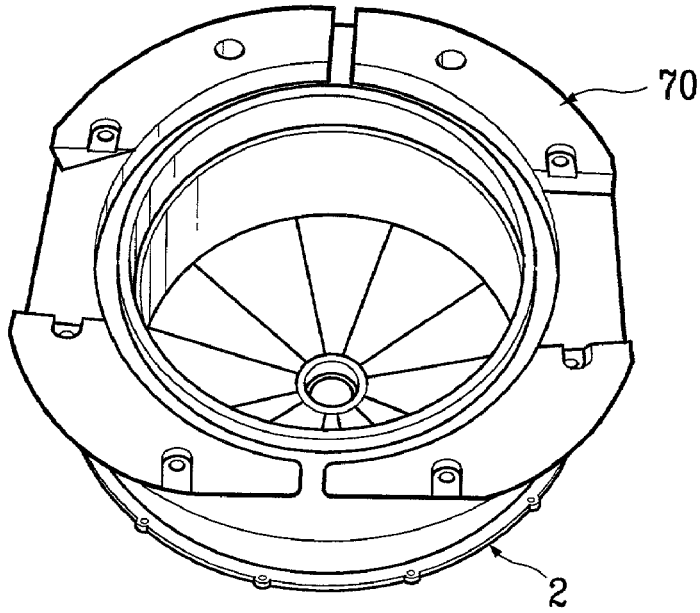
FIG. 9 illustrates a top down view of a balance weight according to the principles of the present invention that is installed on a front face of a tub.

As shown in FIG. 8 and FIG. 9, the first and second embodiment balance weights can be installed on the circumference of, or at the front of, the tub 2. Even though the shapes of the balance weight housings 50 and 70 are different, the structures and functions of the respective components are identical to each other.

A method of manufacturing the above-constructed balance weight according to the second embodiment of the present invention is explained as follows.

First a housing is molded using a metal mold having a predetermined shape. The process is as follows.

Figure 10:
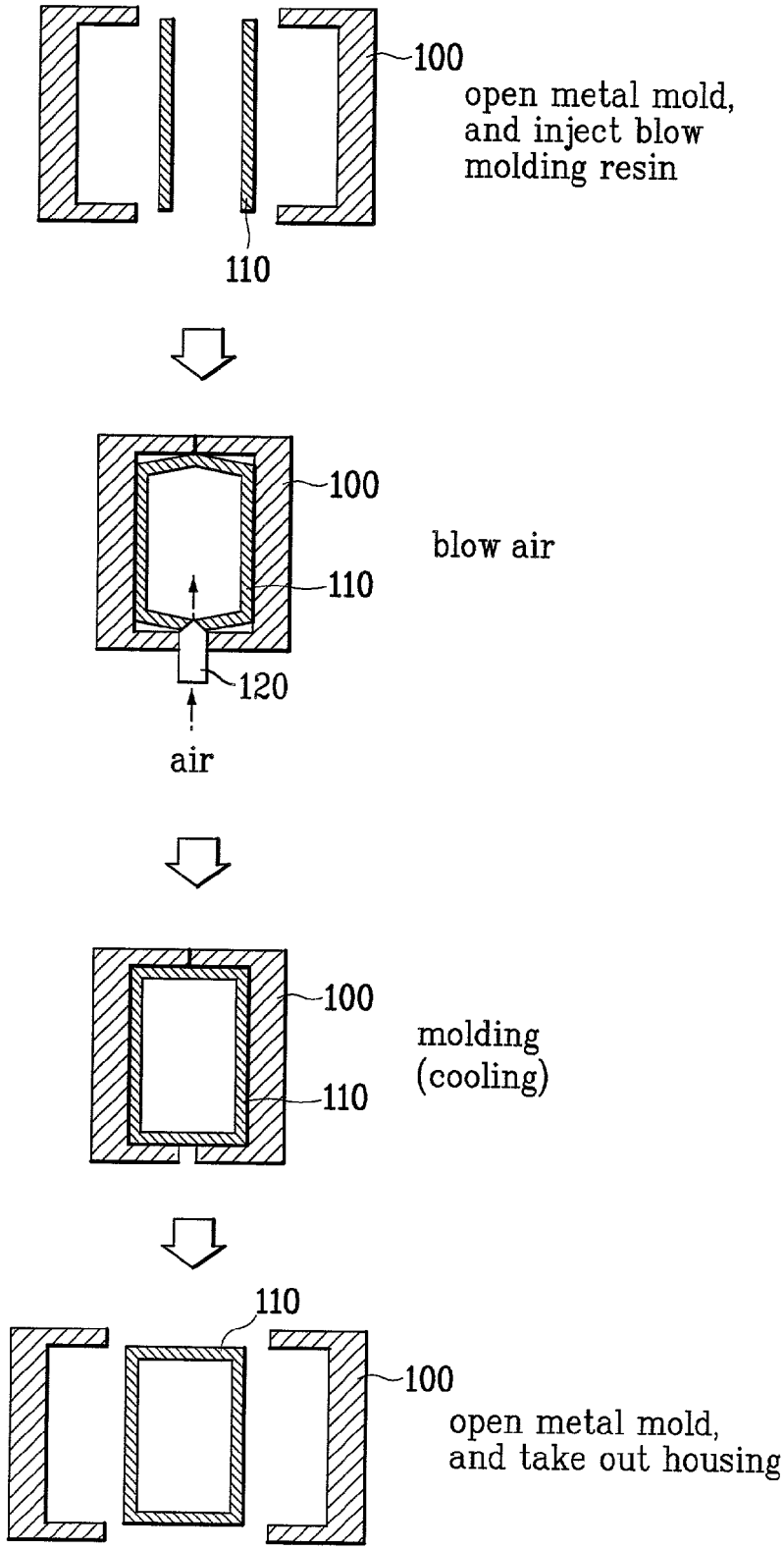
FIG. 10 illustrates a process of forming a housing used in the second embodiment of the present invention.

FIG. 10 illustrates a process of forming the housing of the second embodiment of the present invention. As shown, a metal mold 100 having a predetermined and desired interior shape is opened. Then, a tube 110 made of a blow molding resin is inserted into the metal mold 100. For example, the blow molding resin could be polypropylene, polyethylene, or the like.

The metal mold 100 is then closed, and air is blown into the tube 110 through an air nozzle 120. This blows the tube into the mold. The temperature should be maintained at a sufficient temperature so as not to harden the tube 110. As the tube 110 expands it takes the form of the metal mold 100. Thus, the tube 110 becomes the shape of the housing.

Then, the metal mold 100 is cooled to harden the tube 110. Thus, the housing 50 having the same shape of the inner shape of the metal mold 100 is formed. Thereafter, the metal mold is opened and the housing is removed.

Subsequently, cement 11 is injected into the housing 50. As a plurality of air vents 56 are formed at the bottom surface of the housing 50, the cement 11 is injected uniformly without a void caused by an air pocket. The cement 11 inside the housing 50 is then cured, beneficially either at room temperature or by steam having a temperature higher than the room temperature. Thereafter, the balance weight is complete.

A balance weight for the drum type washing machine according to the present invention and a manufacturing method thereof provides advantages.

First, the balance weight is formed such that cement is solidified in the housing. Fabrication is simplified and product costs are reduced. Exterior trimming, spray processes, boring, and burr removal are not required (as in the related art).

Second, the locking bolt does not directly penetrate the cement, thus cement dust is prevented and fabrication workers are provided with a healthy work environment.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A balance weight for a drum type washing machine, comprising:

a housing having a predetermined inner space and a coupling element for coupling the housing to a washing machine tub, the housing including a bottom surface having a step defined by a first bottom surface and a second bottom surface wherein the first and second bottom surfaces are not co-planer;

a landing recess disposed on a portion of said first bottom surface, the first bottom surface extending beyond the second bottom surface to form the step; and cement in said inner space.

2. The balance weight of claim 1, wherein said housing comprises:

a lower case having a bottom surface and a lateral surface that define the space; and an upper cover in contact with the lower case and sealing the space.

3. The balance weight of claim 2, wherein the lateral surface defines a first insertion hole that passes through the lower case.

4. The balance weight of claim 3, wherein the upper cover includes a protruding wall that passes through the lower case and defines a second insertion hole.

5. The balance weight of claim 4, wherein the protruding wall is longer than the first insertion hole and extends past the bottom surface near the first insertion hole.

6. The balance weight of claim 2, wherein the housing includes a separation prevention mechanism that prevents the upper cover from separating from the lower case.

7. The balance weight of claim 6, wherein the separation prevention mechanism is an undercut that extends from the lateral surface over an edge of the upper cover.

8. The balance weight of claim 6, wherein the separation prevention mechanism comprises a protrusion that extends from an end of the lateral surface, and a hook that extends from an edge of the upper cover and that hooks around the protrusion.

9. The balance weight of claim 2, wherein the housing is an integral structure having an upper surface with a cement injection inlet, a bottom surface; and a lateral surface between the upper and bottom surfaces, wherein the upper surface, the bottom surface, and the lateral surface surround a predetermined space within the housing.

10. The balance weight of claim 9, wherein the coupling element includes an opening through the housing.

11. The balance weight of claim 10, wherein the upper surface includes a concave recess that extends from the opening to an edge of the housing.

12. The balance weight of claim 9, wherein the bottom surface includes a step portion defined by a first bottom surface and a second bottom surface, and wherein the first and second bottom surfaces are not co-planer.

13. The balance weight of claim 12, wherein the bottom surface further includes a leg having a length that is substantially the same as the height of the step.

14. The balance weight of claim 9, wherein the housing includes at least one air vent.

15. The balance weight of claim 14, wherein the air vent is formed through the bottom surface.

16. The balance weight of claim 9, further comprising a flange formed around the cement injection inlet.

17. The balance weight of claim 16, wherein the bottom surface includes a landing recess.

18. The balance weight of claim 17, wherein the landing recess is semicircular.

19. The balance weight of claim 9, further comprising a cover on the cement injection inlet.

20. The balance weight of claim 19, wherein the cover is a wire net solidified by cement.

21. A drum type washing machine, comprising:

a tub having a first coupling element;

a housing having a predetermined inner space and a second coupling element, the housing including a bottom surface having a step defined by a first bottom surface and a second bottom surface wherein the first and second bottom surfaces are not co-planer a landing recess disposed on a portion of said first bottom surface, the first bottom surface extending beyond the second bottom surface to form the step;

cement in said inner space;

a locking mechanism that interacts with the first and second coupling elements to attach said housing to said tub.

22. A drum type washing machine according to claim 21, wherein the first coupling element includes a locking boss, the second coupling element includes an opening, and the locking mechanism includes a locking bolt that passes through the opening and couples to the locking boss.

23. The drum type washing machine of claim 21, wherein said housing comprises:

a lower case having a bottom surface and a lateral surface that define the space; and an upper cover in contact with the lower case and sealing the space.

24. The drum type washing machine of claim 23, wherein the housing includes a separation prevention mechanism that prevents the upper cover from separating from the lower case.

25. The drum type washing machine of claim 24, wherein the separation prevention mechanism is an undercut that extends from the lateral surface over an edge of the upper cover.

26. The drum type washing machine of claim 24, wherein the separation prevention mechanism comprises a protrusion that extends from the end of the lateral surface, and a hook that extends from an edge of the upper cover and that hooks around the protrusion.

27. The drum type washing machine of claim 21, wherein the lateral surface defines a first insertion hole that passes through the lower case.

28. The drum type washing machine of claim 27, wherein the upper cover includes a protruding wall that passes through the lower case and defines a second insertion hole.

29. The drum type washing machine of claim 28, wherein the protruding wall is longer than the first insertion hole and extends past the bottom surface near the first insertion hole.

30. The drum type washing machine of claim 21, wherein the housing is an integral structure having an upper surface with a cement injection inlet, a bottom surface, and a lateral surface between the upper and bottom surfaces, wherein the upper surface, the bottom surface, and the lateral surface surround a predetermined space within the housing.

31. The drum type washing machine of claim 30, wherein the second coupling feature includes an opening through the housing.

32. The drum type washing machine of claim 31, wherein the upper surface includes a concave recess that extends from the opening to an edge of the housing.

33. The drum type washing machine of claim 30, wherein the housing includes at least one air vent.

34. The drum type washing machine of claim 33, wherein the air vent is formed through the bottom surface.

35. The drum type washing machine of claim 30, further comprising a flange formed around the cement injection inlet.

36. The drum type washing machine of claim 30, wherein the landing recess is semicircular.

37. The drum type washing machine of claim 30, further comprising a cover on the cement injection inlet.

38. The drum type washing machine of claim 37, wherein the cover is a wire netting solidified by cement.

39. The drum type washing machine of claim 21, wherein the bottom surface further includes a leg having a length that is substantially the same as the height of the step.

* * * * *